US005640066A

United States Patent [19]

Itou et al.

[11] Patent Number: 5,640,066

[45] Date of Patent: Jun. 17, 1997

[54] DISPLAY SCREEN AND METHOD OF MANUFACTURING THE SAME

[75] Inventors: Takeo Itou, Kumagaya; Hidemi Matsuda, Fukaya; Hajime Tanaka, Fujioka; Tomoko Nakazawa, Maebashi, all of Japan

[73] Assignee: Kabushiki Kaisha Toshiba, Kawasaki, Japan

[21] Appl. No.: 579,607

[22] Filed: Dec. 26, 1995

[30] Foreign Application Priority Data

Dec. 26, 1994 [JP] Japan ..... 6-322061

[51] Int. Cl.[6] ..... H01J 29/10

[52] U.S. Cl. ..... 313/461; 313/473; 313/474; 313/466

[58] Field of Search ..... 313/461, 462, 313/463, 466, 473, 474

[56] References Cited

U.S. PATENT DOCUMENTS 2,959,483 11/1960 Kaplan .
3,114,065 12/1963 Kaplan .
5,101,136 3/1992 Gibilini et al. ..... 313/474

FOREIGN PATENT DOCUMENTS 0427270 5/1991 European Pat. Off. .
4-007055 2/1992 Japan .
4-306531 10/1992 Japan .
4-328225 11/1992 Japan .
5-275008 10/1993 Japan .
5-314929 11/1993 Japan .

OTHER PUBLICATIONS

Database WPI, Section CH, Week 9540, Derwent Publications Ltd., London, GB; Class L03, An 95-305373 & JP-A-07 201 287 (Kinseisha KK), Aug. 4, 1995.

*Primary Examiner*—Sandra L. O'Shea
*Assistant Examiner*—Vip Patel
*Attorney, Agent, or Firm*—Cushman Darby & Cushman, IP Group of Pillsbury Madison & Sutro, L.L.P.

[57] ABSTRACT

According to the present invention, there is provided a display screen having a black matrix of a multilayer structure including a fine pigment particle layer containing fine pigment particles having an average diameter of 0.005 to 0.2 μm, and a black pigment layer containing black pigment particles having an average particle diameter of 0.2 to 5 μm.

11 Claims, 3 Drawing Sheets

DISPLAY SCREEN AND METHOD OF MANUFACTURING THE SAME

BACKGROUND OF THE INVENTION

1. Field of the Invention

The present invention relates to a display screen used in a display apparatus such as a color image receiving tube, and a method of manufacturing such a display screen.

2. Description of the Related Art

On the inner surface of the face plate of a cathode ray tube or a color image receiving apparatus, dot-shaped or striped phosphor layers emitted light colored in red, blue and green are formed. As electron beams collide with these phosphor films, the phosphor films emit light, thus displaying an image. In order to enhance the contrast and the color purity of the display apparatus, there have conventionally been attempts to improve the phosphor layer. For example, there has been proposed a filter-applied phosphor layer having a structure in which a pigment layer of the same color as the emitting color of the phosphor layer is provided between the face plate and the phosphor layer. With this structure, of the external light made incident, the green and blue light components are absorbed by a red pigment film, the green and red light components are absorbed by a blue pigment film, and the blue and red light components are absorbed by a green pigment film. With use of filter-applied phosphor films, the contrast and the color purity of the display apparatus can be enhanced.

As the panel substrate on which phosphor layers are formed, a so-called tint panel or dark tint panel having a light transmittance lower than that of the conventional type of glass panel is conventionally formed, for the purpose of attenuating the external light reflecting components and enhancing the contrast ratio. The filter of such a filter-applied phosphor layer has a function of attenuating the external light reflection components, and therefore it is expected that the filter-applied phosphor layer can be applied to a face plate having a good light transmittance. Such a filter-applied phosphor layer is disclosed in, for example, Jan. Pat. Appln. KOKAI Publication No. 5-275008. However, in the case where such a filter-applied phosphor layer is actually applied to a face plate having a high light transmittance, a new problem occurs. That is, the black matrix does not exhibit a sufficient blackness due to the irregular reflection on the surfaces of particles which are constituents of the black matrix.

The black matrix is usually formed of graphite particles having an average particle diameter of about 0.5 μm. The formation of the black matrix is carried out generally in the following manner. That is, a resist layer is formed at a position corresponding to each color of the inner surface of a panel, and a dispersion solution of graphite particles is applied on the entire surface including the resist layer, followed by drying, and the applied graphite pigment particle layer is removed along with the resist layer.

SUMMARY OF THE INVENTION

The first object of the present invention is to provide a display screen having a good contrast, a high color purity and a high brightness, by forming a black matrix capable of achieving a sufficient blackness.

The second object of the present invention is to provide a method of manufacturing a display screen having a good contrast, a high color purity and a high brightness, by forming a black matrix capable of achieving a sufficient blackness.

According to the first aspect of the present invention, there is provided a display screen having a multilayer structure consisting of a substrate, a fine pigment particle layer containing fine pigment particles having an average diameter of 0.005 to 0.2 μm, formed on the substrate and having a plurality of holes of a dot shape or a stripe shape, and a black pigment layer containing black pigment particles having an average particle diameter of 0.2 to 5 μm and formed on the fine pigment particle layer.

According to the second aspect of the present invention, there is provided a method of manufacturing a display screen, comprising the steps of: forming a resist film by applying a resist on a substrate, followed by drying; forming a resist layer in a shape of a plurality of dots or stripes, by patterning the resist film; forming a fine pigment particle layer by applying a solution containing fine pigment particles having an average diameter of 0.005 to 0.2 μm, followed by drying; forming a multilayer structure of the fine pigment particle layer and a black pigment layer by applying a black pigment solution containing black pigment particles having an average diameter of 0.2 to 5 μm, on the fine pigment particle layer, followed by drying; and forming a plurality of dot- or stripe-shaped holes in the multilayer structure by applying a resist dissolving agent on the multilayer structure so as to dissolve the resist layer and peel the multilayer structure off the resist layer.

According to the present invention, a fine pigment particle layer is provided between a black pigment layer of ordinary-sized particles, so as to prevent irregular reflection of external light, or internal reflection, thus achieving a black matrix having a sufficiently black color. The black matrix, when it exhibits a sufficiently black color, has a high light absorbing effect, thereby achieving a display screen having a high contrast.

In the case where such a black matrix is applied on a substrate having a high light transmittance so as to form a display screen, the reflection of external light can be prevented, thus achieving an excellent color purity, and an image of a high brightness can be obtained without deteriorating the contrast.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1A:
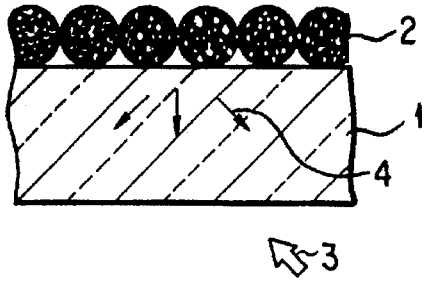
FIG. 1A (PRIOR ART)
FIGS. 1A and 1B are model diagrams for illustrating an operational effect of the present invention.

According to the first aspect of the present invention, there is provided a display screen including a substrate, and a black pigment layer having a plurality of dot-shaped or striped holes, formed on the substrate, said black pigment layer containing black pigment particles having an average particle diameter of 0.2 to 5 μm, wherein a fine pigment particle layer containing fine pigment particles having an average diameter of 0.005 to 0.2 μm, which is shaped similar to that of the black pigment layer is formed between the black pigment layer and the substrate.

In this display screen, the multilayer structure of the fine pigment particle layer and the black pigment layer is formed so as to have a plurality of dot-shaped or striped holes, thus constituting a substantial black matrix. The black pigment layer is substantially made of black pigment particles having an average diameter of 0.2 to 5 μm, which are used for an ordinary black matrix. The fine pigment particle layer is substantially made of fine pigment particles having an average diameter of 0.005 to 0.2 μm, which are smaller than those of the black pigment particles in size. If a layer of black pigment particles having an average diameter of 0.2 to 5 μm is directly formed on the substrate, the diffusion reflection occurs, causing a whity image. However, the fine pigment particle diameters having an average diameter of 0.01 to 0.2 μm has a reflection prevention effect, and can avoid the surface reflection. Therefore, with the fine pigment particles, the diffusion reflection does not occur on the surface of the substrate.

With regard to such a display screen, pigment layers of red, blue and green are provided in the holes as the color pigment layers, and a phosphor layer which emits light of the same color as that of a respective one of the pigment layers, is formed thereon, respectively. The display screen having such a structure can be used as a color cathode ray tube.

With regard to the color cathode ray tube which uses the display surface of the present invention, even if a substrate having a high light transmittance is used, the black matrix is not whitened. Consequently, the contrast is not deteriorated, and the brightness can be improved. Further, due to the effect of the pigment layer, the reflection of the external light on the display screen can be prevented, making it possible to achieve a good contrast and a high color purity.

According to the second aspect of the present invention, there is provided an example of the method of forming a display screen according to the first aspect. The method proceeds in the following manner. First, a resist is applied on a substrate and dried, thus forming a resist film. The resist film is patterned so as to form a plurality of dot-shaped or striped resist layers. After that, a solution containing fine pigment particles having an average diameter of 0.005 to 0.2 μm is applied, followed by drying, thus forming a fine pigment particle layer. On the fine pigment particle layer, a black pigment solution containing black pigment particles having an average diameter of 0.2 to 5 μm is applied and dried, and thus a multilayer structure consisting of the fine pigment particle layer and the black pigment layer is formed. On the multilayer structure, a resist dissolving agent is applied so as to dissolve the resist film and to peel portions of the multilayer structure on the resist layer. In this manner, a plurality of dot-shaped or stripe-shaped holes are formed in the multilayer structure.

According to the present invention, on a substrate having a multilayer structure formed as above, a solution containing color pigment fine particles having an average diameter of 0.005 to 0.2 μm can be applied and dried to form a color pigment solution film, and then the film can be patterned by exposure and development. In this manner, a color pigment layer can be formed optionally in the above-described holes.

Further, a phosphor which emits the same color as that of the obtained color pigment layer is formed optionally on the color pigment layer by a slurry method. Thus, a phosphor surface is formed.

Examples of the fine pigment particles used in the present invention are black pigment and color pigments.

An example of the black pigment used as the fine pigment particle is method oxides. Examples of the color pigments are cobalt blue, cobalt green and red iron oxide.

In order to avoid the scattering of light, the diameter of the particles used in the fine pigment particle layer should be 200 nm, that is, 0.2 μm or less. The particle diameter d, from which the scattering of light occurs, can be obtained by the following formula:

$$d=\lambda/2.$$

The minimum wavelength λ of visible radiation is 400 nm, and when the parameter is substituted by this value, the following can be obtained. That is, $$d=400\ nm/2=200\ nm=0.2\ \mu m.$$

The average diameter of the fine pigment particles should be within a range of 0.005 to 0.2 μm, preferably, 0.01 to 0.15 μm. In terms of optics, the smaller the average diameter of particles, the higher the transparency. However, with consideration of the dispersion property of the application solution, the average particle diameter should be 0.005 μm or larger, preferably, 0.001 μm or larger, but should be 0.15 μm or less in order to avoid the scattering of light assuredly. Further, the ratio in the particle diameter between the fine pigment particles and the black pigment particles should preferably be 0.5 or less.

According to the present invention, the fine pigment particle layer can be formed by applying a solution containing fine pigment particles and drying the solution. This solution is a suspension basically made of fine pigment particles and dispersant. In order to improve its application properties, a surfactant may be added, and in order to enhance its adhesion properties, water-soluble high molecules such as PVA and PVP, acryl emulsion, or inorganic fine particle silica such as colloidal silica, or alumina or the like may be added.

For the black pigment layer, a solution containing similar types of dispersant and additive to those used in the suspension can be applied.

Examples of the dispersant are acrylic-acid-based acryl stylene-based, acryl copolymer-based agents and high-molecular polycarboxylic acids.

Examples of the resist are chromate/POVAL-based, diazonium salts/POVAL-based, stilbazol-based, and chromate/casein-based resist.

Examples of the resist dissolving solution used for dissolving the resist are acids such as sulfamic acid, sulfuric acid and nitric acid, and peroxides such as potassium permanganate potassium periodate and sodium periodate.

The operational effect of the present invention will now be described with reference to drawings.

A black matrix is originally used not to transmit light. In order to increase the light attenuation effect and enhance the absorption effect, the thickness of the matrix should be large. For manufacturing the black matrix, pigment particles having relatively large diameters are used. However, in the case of the pigment particles having large diameters, the scattering of light, which occurs when the light hits the surfaces of the particles, very easily occurs, and therefore the image is whitened due to the irregular reflection caused by the scattering of light when the external light is made incident, thus deteriorating the contrast.

Figure 1B:
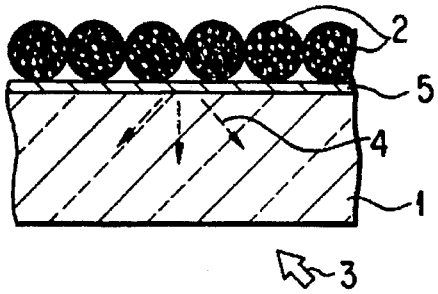

FIGS. 1A and 1B are diagrams designed to illustrate the operational effect of the present invention. FIG. 1A is a diagram showing a state of a black matrix and a substrate, used for a conventional display screen, whereas FIG. 1B is a diagram showing a state of a black matrix and a substrate, used for the display screen of the present invention.

As can be seen in FIG. 1A, in the conventional display screen, a layer of black pigment particles 2 having a relatively large diameter, is formed on a substrate 1. With this structure, on the surface of a pigment particle 2 which is a part of the black matrix formed on the face glass 1, an irregular reflection component 4 is found as an external light is input.

In contrast, in FIG. 1B, a fine pigment particle layer 5 having an average particle diameter smaller than that of the pigment particles 2, is formed between the face glass 1 and the pigment particle 2. With this structure, irregular reflection does not occur at the fine pigment particle layer 5, and the irregular reflection of the pigment particles 2 can be decreased to the minimum level due to its filtering effect. Consequently, the irregular reflection component 4 can be weakened as compared to the case shown in FIG. 1A.

Figure 2A:
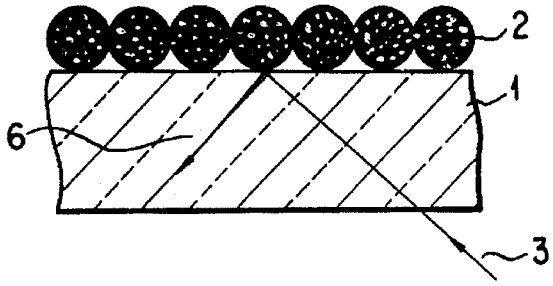
FIG. 2A (PRIOR ART)
FIGS. 2A and 2B are model diagrams for illustrating another operational effect of the present invention.
Figure 2B:
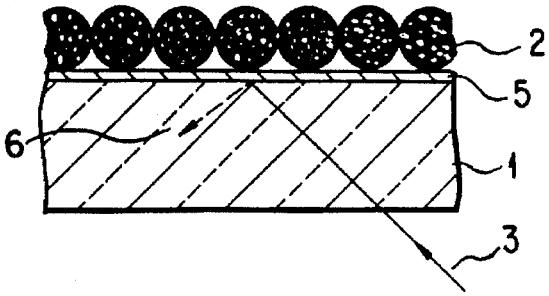

FIGS. 2A and 2B are diagrams designed to illustrate the operational effect of a preferred example of the present invention. FIG. 2A is a diagram showing another state of the black matrix and substrate, used in the conventional display screen, whereas FIG. 2B is a diagram showing another state of the black matrix and substrate, used in the display screen of the present invention. As can be seen in FIG. 2A, with the conventional structure, an internal reflection 6 of the face glass 1 occurred. In contrast, as can be seen in FIG. 2B, in the present invention, it is possible to prevent the internal reflection 6 of the face glass by setting the thickness of the super-fine pigment particle layer 5 to 0.01 μm to 0.5 μm.

Figure 3A:
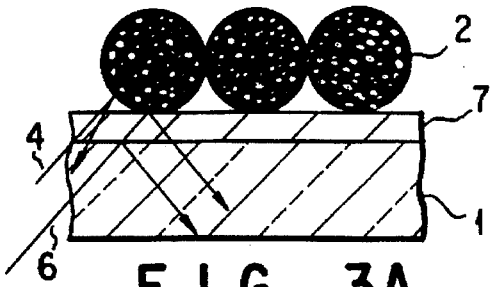
FIGS. 3A and 3B are model diagrams for illustrating still another operational effect of the present invention.
Figure 3B:
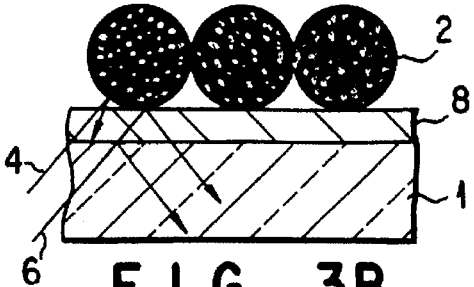

FIGS. 3A and 3B are diagrams designed to illustrate the operational effect of a further preferred example of the present invention. FIG. 3A is a diagram showing a state of the black matrix and another version of substrate, used in the conventional display screen, whereas FIG. 3B is a diagram showing still another state of the black matrix and substrate, used in the display screen of the present invention.

In the display screen shown in FIG. 3A, an internal reflection prevention layer 7 containing fine particles of silicon oxide, is formed on the entire surface of the face plate 1, and black pigment particles 2 of the black matrix are placed on the internal reflection prevention layer 7. The internal reflection prevention layer 7 utilizes the interference effect of reflection light. As indicated by arrow 6 in FIG. 3A, at a boundary section in which a black pigment particle 2 is in contact with the internal reflection prevention layer 7, the condition for no reflection is satisfied, whereas at a most of the section where they are not in contact with each other, the condition for no reflection is not satisfied, causing the scattering of light as indicated by arrow 4. Therefore, the scattering of external light occurs easily in the display screen having the internal reflection prevention layer as shown in FIG. 3A, thus causing the deterioration of the contrast.

In the display screen shown in FIG. 3B, the black matrix has a double-layer structure in which the fine pigment particle layer 8 is formed between the face plate 1 and the black pigment layer 2. With regard to the display screen, at the boundary portions in which the black pigment particles 2 and the fine pigment particle pigment layer 8 are in contact with each other, the condition for no reflection is satisfied, and therefore no reflection occurs as indicated by arrow 6 in FIG. 3B. At the most of the part where the particles 2 and the pigment layer 8 are not in contact, the condition for no reflection is not satisfied, and the scattering of light occurs; however the scattered light is absorbed by the fine pigment particle layer 8 as indicated by arrow 4. As described above, in the display screen according to the above example of the present invention, the external reflection can be sufficiently suppressed and the contrast can be improved due to the above-described two effects.

In order to have a sufficient blackness, the black matrix desirably have a certain thickness, and therefore the black pigment particles desirably have no transparency and have particle diameters of 0.2 μm or larger. It should be noted here that to have no transparency causes the scattering of light. In the case where the black pigment particles have an average diameter of 5 μm or larger, patterning errors, for example, remaining of hole and a decrease in clean-cut property, may be easily occurred. For this reason, the average particle diameter of the black pigment used in the black pigment layer formed on the fine pigment particle layer is set to 0.2 to 5 μm. Further, in consideration of the stability in terms of blackness and clean-cut property, the average diameter of the black pigment preferably be 0.4 to 2 μm.

The resist dissolving solution used in the present invention has a property in which only a resist pattern is removed without influencing the fine pigment particle layer or the first pigment layer, and therefore the general patterning technique, which is conventionally used, can be employed although the black matrix of the present invention has a double-layer structure.

The present invention will now be further described in detail with reference to accompanying drawings.

FIGS. 4A to 4D are cross sections each illustrating a respective step of an example of the present invention method.

EXAMPLE 1

First, a photoresist solution having the following composition was prepared.

| <Photoresist solution> | |
|---|---|
| Polyvinylpyroridon | 3 weight % |
| Bisazide-based crosslinking agent | 0.20 weight % |
| Surfactant | 0.01 weight % |
| Silane-based adhesion helper | 0.01 weight % |
| Pure water | balance |

Figure 4A:
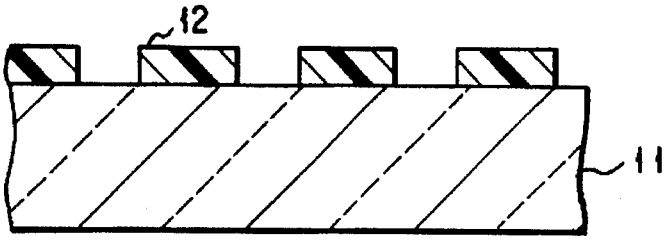
FIGS. 4A to 4D are diagrams illustrating steps of an example of the method of the present invention.

Next, the photoresist solution is applied and dried to form a layer, and the layer is developed into a predetermined pattern by exposing it using a high-pressure mercury lamp via a shadow mask. Thus, a resist pattern 12 is formed on a substrate 11 made of, for example, face glass, as shown in FIG. 4A.

Then, a solution containing first fine pigment particles and a solution containing a second pigment particles, the compositions of which are specified below, were prepared.

| <Solution Containing First Fine pigment Particles> | |
|---|---|
| First pigment particles: | |
| Oxide of Cu, Fe and Mn (average particle diameter 0.05 μm) | 1.0 weight % |
| Dispersion agent: ammoninum salt of polyacrylic acid copolymer (Dispeck GA-40 (Allide Colloide Inc.)) | 1.0 weight % |
| Pure water (in which the above contents were dispersed) | balance |

| <Solution Containing Second Pigment Particles> | |
|---|---|
| Second pigment particles: | |
| Graphite (average particle diameter 1 μm) | 15 weight % |
| Pure water (in which the above contents were dispersed) | balance |

Figure 4B:
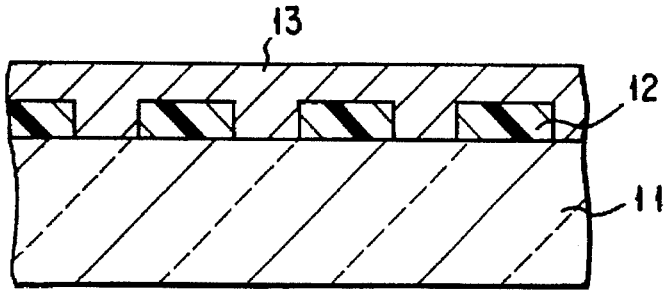
Figure 4C:
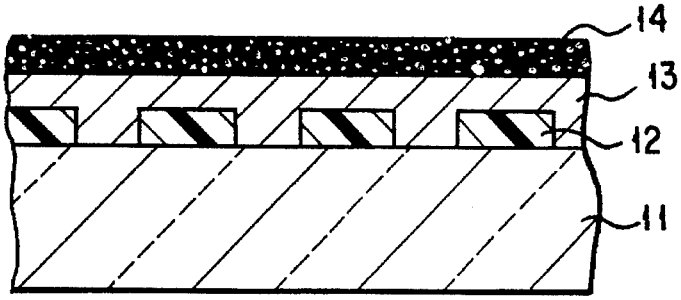

Next, the solution containing the first pigment particles is applied on the substrate 11 and the resist pattern 12, and dried, thus forming a first pigment layer 13 having a thickness of 0.1 μm as shown in FIG. 4B. Subsequently, a solution containing second pigment particles is applied on the first pigment layer and dried, thus forming a second pigment layer 14 having a thickness of 2 μm as shown in FIG. 4C.

Figure 4D:
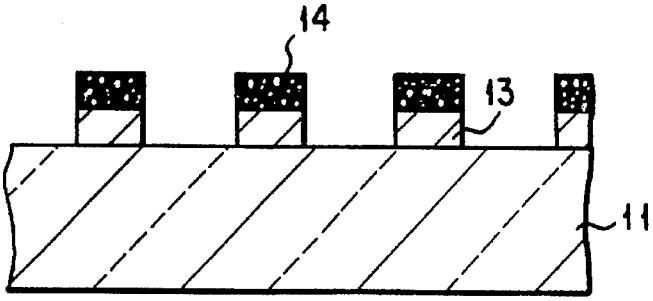

After that, a resist dissolving solution containing sulfamic acid at 10% is applied to peel the resist pattern 12, thereby forming a pattern having a multilayer structure of the first pigment layer 13 and the second pigment layer 14 as shown in FIG. 4D. Thus, a desired black matrix is completed.

EXAMPLE 2

A black matrix was formed by the same method as of Example 1 except that the thickness of the first fine pigment particle layer 13 was set at 0.6 μm.

EXAMPLE 3

A solution containing the first fine pigment particles, which has a different composition from that of Example 1, was prepared.

| <Solution Containing First Fine Pigment Particles> | |
|---|---|
| First fine pigment particles: | |
| Red iron oxide (average particle diameter 0.01 μm) | 1.0 weight % |
| Dispersion agent: ammoninum salt of polyacrylic acid copolymer (Dispeck GA-40 (Allide Colloide Inc.)) | 1.0 weight % |
| Pure water | balance |

A black matrix was prepared under the same conditions as of Example 1 except that the above-specified solution containing the first fine pigment particles, was used.

EXAMPLE 4

A solution containing first pigment particles, which has a different composition from that of Example 1, was prepared.

| <Solution Containing First Fine Pigment Particles> | |
|---|---|
| First fine pigment particles: | |
| Cobalt blue (average particle diameter 0.03 μm) | 2.0 weight % |
| Dispersion agent: ammoninum salt of polyacrylic acid copolymer (Dispeck GA-40 (Allide Colloide Inc.)) | 2.0 weight % |
| Pure water | balance |

A black matrix was prepared under the same conditions as of Example 1 except that the above-specified solution containing the first fine pigment particles, was used, and the thickness of the first pigment layer was set to 0.2 μm.

Comparative Example 1

Figure 5:
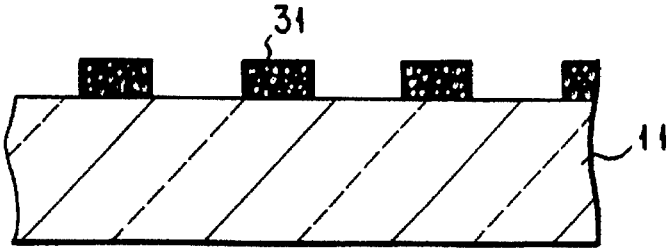
FIG. 5 is a diagram showing an example of a conventional black matrix.

FIG. 5 is a diagram showing an example of the conventional black matrix. As a comparison to the so-far-described examples, a black matrix formed by forming a pattern of the pigment layer 31 having a thickness of 2 μm, and containing pigment particles having an average particle diameter of 1 μm and made of graphite, on a substrate 11 as shown in FIG. 4.

Comparative Example 2

Figure 6A:
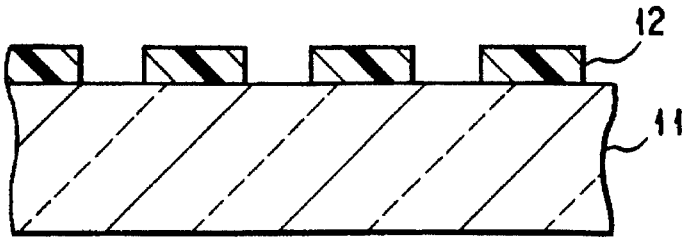
FIGS. 6A to 6C are diagrams illustrating an example of the method of manufacturing a conventional black matrix.
Figure 6B:
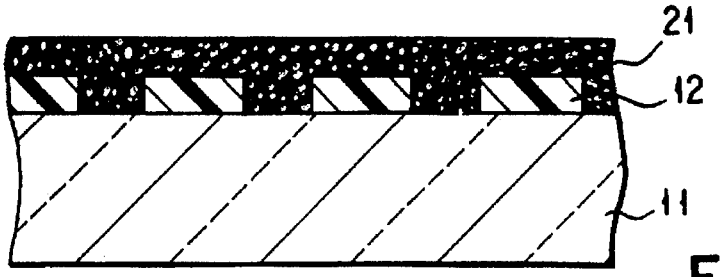
Figure 6C:
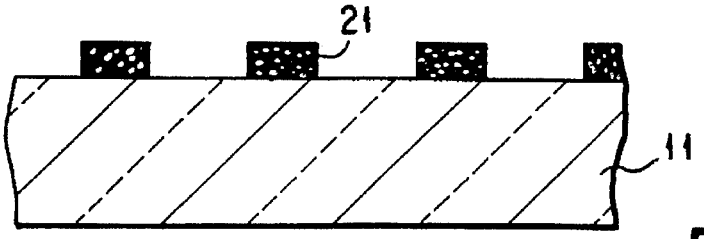

FIGS. 6A to 6C are cross sectional views each illustrating a step of an example of the process for manufacturing a conventional black matrix. A photoresist solution similar to that used in Example 1 was applied and dried. Thus formed layer was exposed using a high-pressure mercury lamp via a shadow mask and developed into a predetermined mask, thus forming a resist pattern 12 on a substrate 11 made of, for example, face glass, as shown in FIG. 6A.

Next, a solution containing first pigment particles and a solution containing second pigment particles similar to those used in Example 1 were mixed at a ratio of 1:2 to prepare a mixture solution, and this solution was applied on the substrate 11 and the resist pattern 12, followed by drying, thus forming a pigment layer 21 having a thickness of 2 μm as shown in FIG. 6B.

After that, the resist dissolving solution similar to that used in Example 1 is applied to peel the resist pattern 12, there by forming a pattern of pigment layer 21 as shown in FIG. 6C.

The above-described examples were examined in terms of component of irregular reflection of external light and internal reflection of substrate 11, and the results were as summarized in the following TABLE 1.

TABLE 1

| | Irregular Reflection | Internal Reflection |
|---|---|---|
| Example 1 | ○ | ○ |
| Example 2 | ○ | Δ |
| Example 3 | ○ | ○ |
| Example 4 | ○ | ○ |
| Comparative Example 1 | x | x |
| Comparative Example 1 | Δ | Δ |

In the above TABLE, ○ indicates a significant improvement in irregular reflection or internal reflection, Δ indicates a fair improvement and x indicates a similar reflection to that of the conventional level or less.

As can be understood from TABLE 1, in Embodiments 1 to 4, the irregular reflection component of external light such as shown in FIG. 1A can be eliminated due to the presence of the fine pigment particle layer 13 containing fine particles having an average particle diameter of 0.01 to 0.2 μm, and such an elimination does not depend on the color of the fine particles.

Especially, in Embodiments 1, 3 and 4, the thickness of the fine pigment particle layer 13 is set within a range of 0.1 to 0.4 μm, and therefore, the internal reflection of the substrate 11 as shown in FIG. 2A can be prevented. In Comparative Example 2, fine particles and black pigment particles were mixed within the pigment layer 21, the irregular reflection and the internal reflection could be improved better than those of Comparative Example 1; however, the degree of the improvement was lower than those of Examples 1, 3 and 4. This is considered because fine particles do not exist entirely between the substrate 11 and the black pigment particles.

In Examples 1 to 4, the pattern of the multilayer structure of the fine pigment particle layer 13 and the black pigment layer 14 can be formed at once without having to separately pattern the fine pigment particle layer 13 and the black pigment layer 14, due to the function of the resist dissolving solution.

Figure 7:
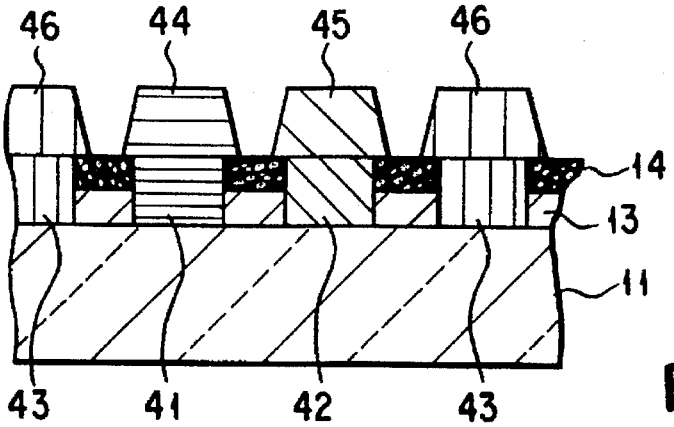
FIG. 7 is a diagram showing a phosphor surface used in the display surface of the present invention.

With regard to the black matrix described in each of Examples 1 to 4, a blue pigment layer 41, a green pigment layer 42 and a red pigment layer 43 are formed first, and then a blue phosphor layer 44, a green phosphor layer 45 and a red phosphor layer 46 are formed so as to correspond to the blue pigment layer 41, the green pigment layer 42 and the red pigment layer 43, respectively, thus forming a desired filter-applied phosphor layer as shown in FIG. 7.

A color cathode ray tube which uses thus obtained filter-applied phosphor layer exhibits an excellent contrast and an excellent color purity because of the improvement in blackness of the black matrix.

Lastly, the above descriptions were made in connection with the case where the present invention was applied to a phosphor layer with filter; however naturally, the present invention can be applied to a phosphor layer without a filter, or the like.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A display screen having a multilayer structure comprising: a fine pigment particle layer containing fine particles having an average diameter of 0.005 to 0.2 μm, formed on a substrate and having a plurality of holes of a dot shape or a stripe shape; and a black pigment layer containing black pigment particles having an average particle diameter of 0.2 to 5 μm and formed on the fine pigment particle layer.

2. A display screen according to claim 1, wherein said dot shape is rectangular or circular.

3. A display screen according to claim 1, wherein said average particle diameter of said fine pigment particles is within a range of 0.01 to 0.15 μm.

4. A display screen according to claim 1, wherein a thickness of said fine pigment particle layer is within a range of 0.01 to 0.5 μm.

5. A display screen according to claim 1, wherein said fine particles is of a type selected from the group consisting of black pigment particles and color pigment particles.

6. A display screen according to claim 1, wherein a ratio between said average particle diameter of said fine particles and said average particle diameter of said black pigment particles is 0.5 or less.

7. A method of manufacturing a display screen, comprising the steps of:

forming a resist film by applying a resist on a substrate, followed by drying;

forming a resist layer in a shape of a plurality of dots or stripes, by patterning the resist film; forming a fine pigment particle layer by applying a solution containing fine pigment particles having an average diameter of 0.005 to 0.2 μm, followed by drying, thereby forming a fine pigment particle layer;

applying a black pigment solution containing black pigment particles having an average diameter of 0.2 to 5 μm, on the fine pigment particle layer, followed by drying, thereby forming a multilayer structure of the fine pigment particle layer and a black pigment layer; and applying a resist dissolving agent on the multilayer structure so as to dissolve the resist layer and peel the multilayer structure off the resist layer, forming a plurality of dot- or stripe-shaped holes in the multilayer structure.

8. A method of manufacturing a display screen according to claim 7, wherein said dot shape is rectangular or circular.

9. A method of manufacturing a display screen according to claim 7, wherein said average particle diameter of said fine pigment particles is within a range of 0.01 to 0.15 μm.

10. A method of manufacturing a display screen according to claim 7, wherein a thickness of said fine pigment particle layer is within a range of 0.01 to 0.5 μm.

11. A method of manufacturing a display screen according to claim 7, wherein said fine pigment particles is of a type selected from the group consisting of black pigment particles and color pigment particles.

* * * * *